US005348752A

United States Patent [19]

Gorlich

[11] Patent Number: 5,348,752

[45] Date of Patent: Sep. 20, 1994

[54] DUAL STATE FOOD PACKAGING

[75] Inventor: Michael P. Gorlich, Hilton Head Island, S.C.

[73] Assignee: World Class Packaging Systems, Inc., Hilton Head Island, S.C.

[21] Appl. No.: 64,700

[22] Filed: May 20, 1993

[51] Int. Cl.[5] ..... B65D 81/20; B65D 1/34

[52] U.S. Cl. ..... 426/129; 426/124; 426/127; 426/396; 426/415; 206/484.1; 220/256; 220/257; 220/258; 229/125.35; 229/123.1; 53/449; 53/434

[58] Field of Search ..... 426/124, 118, 112, 129, 426/127, 396; 229/125.35, 123.1; 220/256, 257, 258; 53/449, 478, 329.5, 254; 206/484.1, 439

[56] References Cited

U.S. PATENT DOCUMENTS

| | | | |
|---|---|---|---|
| 2,887,244 | 5/1959 | Betner | 220/257 |
| 3,344,974 | 10/1967 | Bodstrom . | |
| 3,388,827 | 6/1968 | Thanhauser et al. | 220/60 |
| 3,391,847 | 7/1968 | Christine et al. | 220/257 |
| 3,552,634 | 1/1971 | Ollier et al. . | |
| 3,561,668 | 2/1971 | Bergstrom . | |
| 3,574,642 | 4/1971 | Weinke . | |
| 3,681,092 | 8/1972 | Titchenal et al. | 426/124 |
| 3,770,119 | 11/1973 | Hultberg et al. | 206/439 |
| 3,904,074 | 9/1975 | Hoffman et al. | 220/258 |
| 3,997,677 | 12/1976 | Hirsch et al. | 426/113 |
| 4,055,672 | 10/1977 | Hirsch et al. | 426/129 |
| 4,124,141 | 11/1978 | Armentrout | 426/396 |
| 4,201,795 | 5/1980 | Yamanaka | 426/110 |
| 4,300,700 | 11/1981 | Chang | 220/257 |
| 4,340,138 | 7/1982 | Bernhardt | 229/125.35 |
| 4,346,833 | 8/1982 | Bernhardt | 220/257 |
| 4,350,263 | 9/1982 | Hoffman | 220/258 |
| 4,469,258 | 9/1984 | Wright et al. . | |
| 4,555,043 | 11/1985 | Bernhardt | 220/306 |
| 4,555,056 | 11/1985 | Bernhardt | 229/45 |
| 4,815,602 | 3/1989 | Schirmer | 426/124 |
| 4,818,548 | 4/1989 | Cheng | 426/129 |
| 4,840,271 | 6/1989 | Garwood | 406/129 |
| 4,886,690 | 12/1989 | Davis et al. | 428/36.6 |
| 4,889,731 | 12/1989 | Williams, Jr. | 426/106 |
| 4,901,505 | 2/1990 | Williams, Jr. | 53/412 |
| 4,910,033 | 3/1990 | Bekele et al. | 426/129 |
| 4,939,332 | 7/1990 | Hahn | 426/113 |
| 4,991,717 | 2/1991 | May | 220/256 |
| 5,007,231 | 4/1991 | Ingemann | 220/257 |
| 5,132,151 | 7/1992 | Graney | 428/40 |
| 5,156,329 | 10/1992 | Farrell | 229/125.35 |
| 5,226,531 | 7/1993 | Garwood | 426/129 |

FOREIGN PATENT DOCUMENTS

| | | | |
|---|---|---|---|
| 2539351 | 3/1977 | Fed. Rep. of Germany | 426/129 |
| 6615638 | 5/1967 | Netherlands | 220/256 |

*Primary Examiner*—Steven Weinstein
*Attorney, Agent, or Firm*—Arnold, White & Durkee

[57] ABSTRACT

Dual state packaging may be implemented with a tray having a peripheral flange adapted to receive a pair of membranes to enclose the tray. The lower membrane is the more permeable of the two. It may be attached to a first surface of the flange. The second membrane is attached to a second outer surface of the flange without direct connection except through the tray to the more permeable membrane. The two connection surfaces may be separated by a depression to facilitate the cutting away of the material forming the more permeable membrane in a continuous manufacturing process. With the less permeable membrane in place, a desired gaseous environment may be maintained within the package. When it is desired to change the gaseous environment, the upper less permeable membrane may be peeled away allowing gaseous communication through the lower more permeable membrane.

9 Claims, 2 Drawing Sheets

DUAL STATE FOOD PACKAGING

FIELD OF THE INVENTION

This invention relates to the packaging of food products such that the packaged product may be maintained in one condition under certain circumstances and then converted to another condition. For example, during transportation, the food package might maintain an inert gaseous atmosphere and then when the package reaches a supermarket or other retail outlet, the food package would permit exposure of the food product to the ambient atmosphere. While a wide variety of food products can be packaged in accordance with the teachings of this invention, it is particularly advantageous in connection with the packaging of meat such that the meat may be transported in an inert atmosphere and then caused to bloom when it reaches a retail outlet by exposure to oxygen.

BACKGROUND OF THE INVENTION

Historically, meat products have been butchered and packaged in each supermarket or other retail outlet. It has long been recognized that this arrangement is extremely inefficient and expensive. Instead, it would be preferable to permit the meat to be butchered and packaged at an efficient facility which benefits from economies of scale and thereafter shipped to individual supermarkets or other retail outlets. Moreover, because of problems with proper disposal of waste, butchering at a central location is preferable.

In the past, this desirable goal has not been achievable because most consumers prefer to buy meat which is red in color as a result of exposure to oxygen. However, the meat maintains its red color for only one to two days. Thereafter, it turns a purple color which is undesirable to most consumers.

Therefore, if the meat was butchered and packaged in one location and then shipped to another location for eventual sale, by the time the package reached the retail outlet the meat would have undergone the transformation to the purple color and would be effectively unsalable.

To overcome these problems, there have been a number of efforts to maintain the food product in a first atmosphere during shipping and a second atmosphere when the meat product is ready for retail sale. It is not believed that any of these techniques have yet achieved significant commercial acceptance. Therefore, it is highly desirable to provide a package that would permit remote meat preparation and subsequent sale after the passage of more than a couple of days.

One problem is that while the need for such a package is great, consumers may not be willing to invest a large amount of money in elaborate packages. Thus, it would be highly desirable to have a package that is convertible between two very different packaging conditions and yet is very economical. Moreover, it is also advantageous for the package to look similar to packages to which consumers are currently accustomed.

One approach that has been attempted to overcome those problems is to use a dual layer cover over a plastic package containing the meat product. The upper cover is gas impermeable and may be removed to expose a lower cover which is air permeable. Thus, the package may be shipped with the upper cover intact so that an inert gaseous atmosphere may be maintained within the package during shipping. Then the upper cover may be removed at the supermarket leaving the lower cover. Since the lower cover is oxygen permeable, it allows the meat to bloom in the presence of oxygen.

Conventionally, such dual layer packages have been implemented by adhesively securing the upper layer to the lower layer and thereafter heat sealing or otherwise securing both layers to the package itself. The inventor of the present invention has appreciated that these approaches have a number of drawbacks. Firstly, when the upper layer is removed the adhesive may be retained on the lower layer interfering with the ability of the lower layer to pass oxygen. Secondly, when removing the top layer it may be difficult to avoid tearing or otherwise removing the lower layer. Thirdly, it is difficult to produce such a package with controlled delamination of the two layers.

While various elaborate techniques have been conceived for avoiding the interference between the layers, these approaches generally add cost and complexity to the packaging. Moreover, the removal of the upper layer (which is sealed to the lower layer) without removing the lower layer is problematic. Attempts have been made to overcome these problems; however, no commercially viable solution has been achieved at this point.

Thus, it should be apparent that there is a continuing need to solve the long standing problem of providing a package which permits meat or other food products to be packaged at one location and then to be sold sometime later under different conditions.

SUMMARY OF THE INVENTION

These and other important advantages of the present invention may be achieved by a package for permitting gaseous communication with the atmosphere comprising a tray and a more permeable membrane secured to the tray. A less permeable membrane is secured to the tray over the more permeable membrane such that the membranes are not directly connected to one another.

In accordance with another aspect of the present invention, a package selectively permits gaseous communication with the atmosphere. The package includes a tray and a more permeable membrane attached to the tray. A less permeable membrane is attached to the tray over the more permeable membrane. The tray is adapted to facilitate the severance of the more permeable membrane in place on the tray.

In accordance with yet another embodiment of the present invention, a package for selectively permitting gaseous communication with the atmosphere includes a tray, a more permeable membrane attached to the tray, and a less permeable membrane also attached to the tray. The membranes are attached to the tray at different locations.

In accordance with another aspect of the present invention, a tray includes a substantially rigid plastic base for containing a food product. A peripheral flange is connected to the base. A pair of spaced ledges are formed on the flange. A depression, extending in the same direction as the base, is located between the ledges.

In accordance with still another embodiment of the present invention, a method for packaging food products so as to permit gaseous communication with the atmosphere includes the steps of placing a meat product within a plastic tray and covering the tray with a more permeable membrane. The more permeable membrane is cut from a web in place on the tray and thereafter a less permeable membrane is positioned on the tray and secured thereto over the less permeable membrane without directly connecting the less permeable membrane and the more permeable membrane.

In accordance with yet another aspect of tile present invention, a method for packaging food includes the step of placing a tray in a conforming carrier. A web of permeable membrane material is unwound. Then the permeable membrane material is secured to the tray along a first peripheral ledge of tile tray. The secured membrane material is severed from the web in place on the tray. A web of impermeable membrane material is unwound from a web. The impermeable membrane material is secured to the tray over the permeable membrane material.

DETAILED DESCRIPTION OF THE PREFERRED EMBODIMENT

Figure 1:
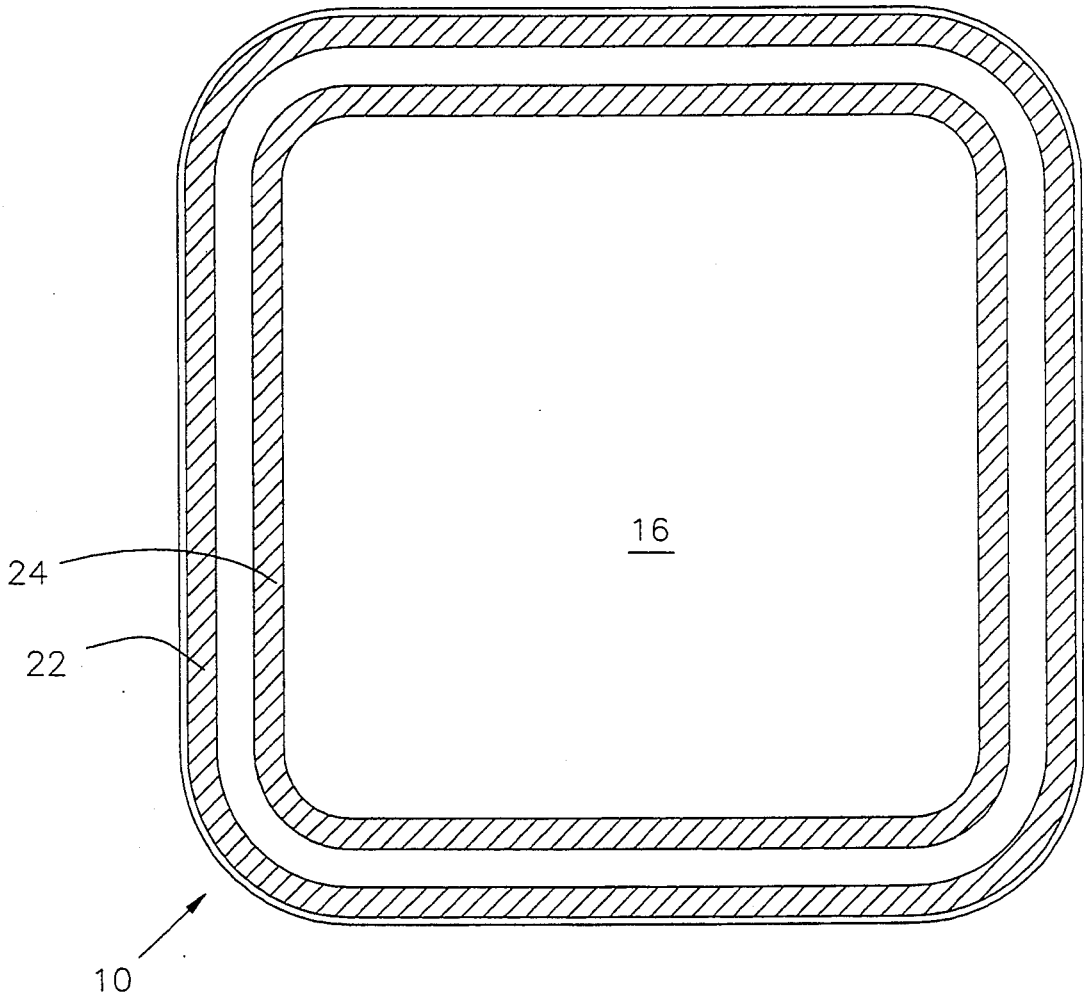
FIG. 1 is a plan view of one embodiment of the present invention.

Referring to the drawings wherein like reference characters are used for like parts throughout the several views, a package for containing a food product "A" such as red meat is shown in FIG. 1. The package 10 includes three major components, a relatively rigid tray 12, a more permeable membrane 14, and a less permeable membrane 16. The membranes 14 and 16 are peripherally connected to the tray 12.

The tray 12 may be made of a relatively rigid plastic by thermomolding or the like. The tray is preferably made of a material which is gas impermeable and may be composed of a single polymeric sheet such as polyvinyl chloride, nylon, fluorohalocarbon, polyurethane or a composite of polymeric materials including: PVC; PVC and polyolefin; PVC and saran; PVC and saran and polyolefin; PVC, saran, ethylenevinylacetate copolymer; polystyrene, saran and polyolefin; polystyrene, saran anti copolymer; nylon, saran, polyolefin; polyolefin, saran and polyethylene; polyester, saran, polyolefin: polycarbonate, saran and polyolefin; or many other materials which are well known in the art. Advantageously, the tray 12 is formed of a material which forms a good oxygen barrier, has adequate thermoformability, is sufficiently strong and permits the attachment of other materials to the tray.

Figure 2:
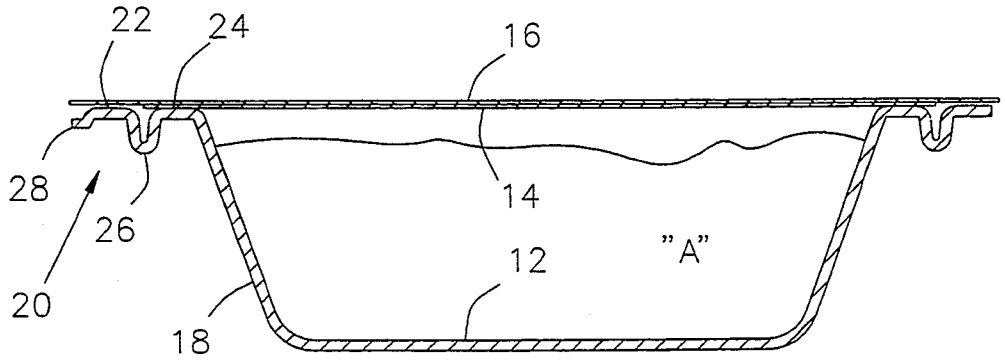
FIG. 2 is an enlarged cross-sectional view taken along the lines 2—2 in FIG. 1.

The tray 12 includes a curved base 18 which defines a cavity for receiving the food product A, as shown in FIG. 2, and a double flanged edge 20 which extends around the periphery of the base 18.

The double flanged edge 20 defines a pair of lands or ledges 22 and 24 separated by a depression 26. The outermost edge 28 of the flange 20 may be turned downwardly. It is convenient to mold the base 18 and the flange 20 as a single piece.

The more permeable layer 14 may be formed in a conventional fashion to permit gaseous exchange as required for the particular application. In connection with the blooming of red meat, it is generally desirable that the more permeable membrane 14 be highly transmissive of ambient atmosphere. Moreover, it is desirable that the membrane 14 be of a material that is heat sealable to the tray 12. Particularly, the membrane 14 is secured to the tray 12 at the inner ledge 24. Conveniently, this may be done by heat sealing; however, it is also possible to adhesively secure the peripheral edge of the membrane 14 to the inner ledge 24.

A wide variety of materials are capable of acting as the layer 14 including polyvinyl chloride, polycarbonate, cellophane, polypropylene, polyethylene, polyethylene copolymers, ionomer film or any other gas permeable materials which are well known in the art. The membrane 14 may also be constructed of microporous films which have holes formed either chemically or mechanically. This layer need be made only sufficiently strong to prevent perforation in use.

The upper membrane 16 is removably secured to the outer ledge 22, again by heat sealing, adhesive techniques or any other technique known in the art. The upper membrane 16, when secured to the ledge 22, is totally free of any connection other than frictional connection to the more permeable membrane ! 4 except indirectly through the tray 12. This facilitates the removal of the upper membrane 16 from the package so as to leave the lower membrane 14 in place and undisturbed.

The upper membrane 16 may be selected from the relatively more gas impermeable materials such as polyester, nylon, cellophane, polypropylene, polyvinyl acetate, saran or combinations of these materials. Advantageously, the upper membrane is impermeable to gases.

After both the membranes 14 and 16 are secured to the tray 12, a desirable atmosphere may be maintained within the package for the benefit of the food product A contained therein. In the case of red meat products, the initial atmosphere in some embodiments can be such that it contains a relatively low concentration of oxygen. For example, gases including substantial concentrations of carbon dioxide or nitrogen may be maintained with the package to reduce the exposure of the food product A to oxygen. In the case of meat products, this forestalls the blooming of the meat product until a later time.

When the product reaches a supermarket or other retail outlet, it may be desirable to remove the upper less permeable membrane 16. This is conveniently done by grasping the edge of the upper membrane 16 and pulling it upwardly. Since the membrane 16 is in no way connected to the membrane 14, it may be easily removed from the remainder of the package.

Thereafter, the package 10 exists without the upper membrane 16 and includes only the more permeable membrane 14 and the tray 12. In embodiments containing meat products, it may be desirable to allow oxygen transmission through the permeable membrane 14 to cause blooming of the meat product. Thus, in the store, once the upper membrane 16 has been removed, the red meat product A can be caused to turn red or bloom in the presence of a higher concentration of oxygen.

Figure 3:
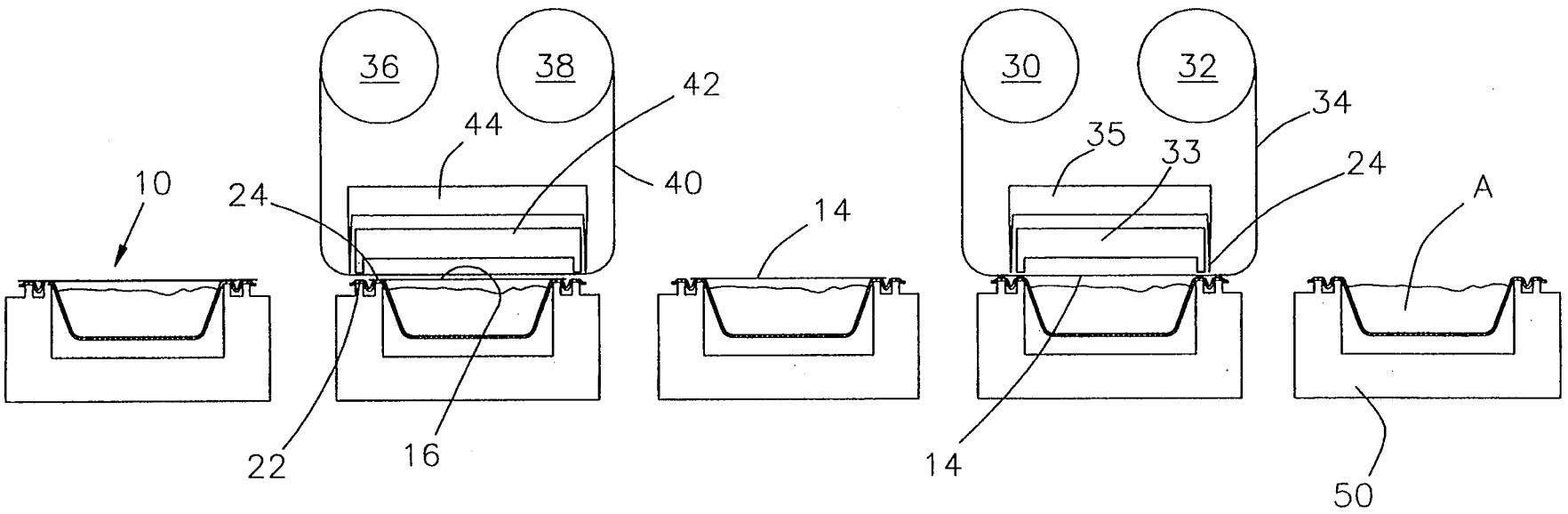
FIG. 3 is a schematic view showing a method for assembling the package shown in FIG. 1.

Referring to FIG. 3, the process for forming the package 10 may be understood by those skilled in the art. Starting at the right side of FIG. 3, a tray 12, held from below in a rigid conforming carrier 50, is filled in a conventional fashion with a food product A. Next, the package is evacuated of oxygen and gas back-tilled with a transportation gas which is lower in oxygen content. The more permeable membrane 14 is unwound from a pair of rolls 30 and 32 and positioned over the tray 12. The more permeable membrane 14 is secured to the inner ledge 24, for example by heat sealing machine 33.

Thereafter, a conventional cutting machine 35 is used to cut the web 34 at a position over the depression 26. It should be clear that the depression 26 facilitates the removal or cutting of the membrane 14 from the web in place on the package. The web 34 may also be severed by using heat or ultrasonic energy or the like.

At the next station, the less permeable web is unrolled from a pair of rolls 36 and 38 so that the less permeable web 40 may be positioned on the package 10. Likewise, the less permeable membrane 16 is secured to the ledge 22 using conventional techniques such as heat sealing machine 42. At this point, the transportation gas is sealed inside the package 10. Finally, the web 40 is cut by conventional cutting equipment 44 at the edge 28. This leaves a loose piece of the less permeable material 16 which may be grasped by the user to remove the membrane 16 when appropriate.

In this condition, the package may be shipped to other locations for retail sale. At the retail establishment, the package is held until the package is ready to be displayed. At that point, the less permeable membrane 16 is peeled away and discarded. After a short holding period, the package may be displayed for retail sale. The holding period is necessary to allow the package to absorb oxygen through the too:re permeable membrane 14. After the meat product has bloomed, it can be displayed for retail sale.

It can be understood that through tile provision of tile depression 26, both membrane materials may be attached to the same tray 12 in a fashion that permits high speed manufacture. While the simplified process depicted in FIG. 3 suggests that the material may be packaged in a serial fashion, this approach would likewise apply to conventional packaging equipment.

Advantageously, the more permeable membrane is sufficient to maintain the desired gaseous environment in the package until the less permeable membrane is in place. This is especially true with high speed systems. However, in some circumstances it may be useful to provide a particular gaseous atmosphere between the stations where the more permeable and less permeable membranes are applied.

Thus, it is apparent that there has been provided, in accordance with the invention, a method and apparatus that fully satisfies the aims and obvious advantages set forth above. While the invention has been described in connection with specific embodiments thereof, it is evident that many alternatives, modifications and variations will be apparent to those skilled in the art in light of the foregoing description. Accordingly, it is intended to embrace all such alternatives, modifications and variations as follow the spirit and scope of the appended claims.

I claim:

1. A package for selectively permitting gaseous communication with the atmosphere comprising:

a tray having sidewalls defining a cavity;

a product to be exposed to varying gaseous conditions contained in said cavity of said tray;

said tray comprising an outwardly directed flange extending around the perimeter of said tray;

said flange comprising an inner flange portion adjacent said sidewalls and an outer flange portion that is further away from said sidewalls than said inner flange portion;

said flange further comprising a depressed portion between said inner and outer flange portions, said depressed portion extending downwardly from and connected to both said inner and outer flange portions to form a depression in said flange, said inner and outer flange portions and said depression extending completely around the perimeter of said tray;

said package further comprising an upper membrane and a lower membrane;

said lower membrane being more gas permeable than said upper membrane;

said lower membrane extending entirely across the cavity of said tray and secured to said inner flange portion completely around its perimeter to enclose said product in said tray cavity;

said upper membrane, being less gas permeable than said lower membrane, completely coveting said lower membrane but being unsecured to said lower membrane;

said upper membrane being secured to said outer flange portion to completely seal and enclose the lower membrane and the product in the tray cavity;

said lower membrane not extending outwardly beyond said depression and onto said outer flange portion; and said lower membrane being obtained from a larger web of material, and said depression is designed to facilitate the cutting of said lower membrane from said web after said web is placed on said tray during manufacture of said package.

2. The package of claim 1 wherein the product is red meat.

3. The package of claim 2 wherein said lower membrane is sufficiently permeable to oxygen to permit blooming of said meat product contained within the package.

4. The package of claim 3 wherein said upper membrane is substantially impermeable to oxygen.

5. The package of claim 1 wherein said upper membrane of said package maintains an atmosphere in said cavity having a substantially lower concentration of oxygen than that found in the ambient atmosphere.

6. The package of claim 1 wherein said depression is integrally formed in said tray.

7. The package of claim 1 wherein said tray is formed of relatively rigid plastic.

8. The package of claim 1 wherein said upper and lower membranes are composed at least in part of plastic.

9. The package of claim 1 wherein said upper membrane is peelable from said tray.

* * * * *